United States Patent [19]

Sheffer

[11] Patent Number: 4,657,520

[45] Date of Patent: Apr. 14, 1987

[54] PROMOTIONAL BAY TRAILER ASSEMBLY

[75] Inventor: Phil B. Sheffer, New Oxford, Pa.

[73] Assignee: Merchandising Innovations, Inc., Hanover, Pa.

[21] Appl. No.: 836,295

[22] Filed: Mar. 5, 1986

[51] Int. Cl.[4] ..... A63H 33/16; G09F 1/08

[52] U.S. Cl. ..... 446/488; 446/79; 446/80; 40/539; D9/433

[58] Field of Search ..... D9/433; 446/434, 488, 446/80, 79, 76, 93, 88; 40/539

[56] References Cited

U.S. PATENT DOCUMENTS

| | | | |
|---|---|---|---|
| D. 260,082 | 8/1981 | Johnson | D9/433 |
| D. 269,324 | 6/1983 | Klein | D9/433 |
| 654,219 | 7/1900 | Bender | 446/76 |
| 1,009,804 | 11/1911 | Sugarman | D9/433 X |
| 1,250,348 | 12/1917 | Pente | 446/76 |
| 1,743,572 | 1/1930 | Schurr | 446/76 X |
| 2,028,377 | 1/1936 | Bernasconi | 446/488 X |
| 2,793,801 | 5/1957 | Papadopolous | D9/433 X |

FOREIGN PATENT DOCUMENTS

| | | | |
|---|---|---|---|
| 1001170 | 1/1957 | Fed. Rep. of Germany | 446/434 |
| 925910 | 9/1947 | France | 446/80 |
| 1047344 | 12/1953 | France | 446/80 |

*Primary Examiner*—Robert A. Hafer
*Assistant Examiner*—Terrence L. B. Brown
*Attorney, Agent, or Firm*—Daniel J. O'Connor

[57] ABSTRACT

A display article comprising a promotional bay trailer assembly which is made entirely of corrugated fiberboard materials. A series of cuts and score lines permits the article to be shipped in a completely flat or knock-down position. Upon receipt by the retail merchant, consumer or collector, the device may be readily assembled into a highly durable and attractive unit. No separate fasteners or glue of any kind are required for assembly of the unit which may be easily completed even by persons unfamiliar with display assembly techniques. It is contemplated that the device would be suitable for advertising and hobby/collector uses.

1 Claim, 2 Drawing Figures

PROMOTIONAL BAY TRAILER ASSEMBLY

This application is generally related to applicant's copending U.S. application Ser. No. 06/832,631 filed Feb. 25, 1986 and Ser. No. 06/836,296 filed Mar. 5, 1986.

Papers relating to the present invention were previously filed under the Disclosure Document Program of the U.S. Patent Office.

BACKGROUND AND OBJECTS OF THE INVENTION

The invention relates generally to display or promotional items which are manufactured of corrugated fiberboard or other easily workable materials.

It would be highly desirable in the advertising and merchandising arts to mass produce attractive advertising articles which may be shipped in a flat or knockdown position and yet easily assembled by the retail merchant.

Accordingly, it is an object of the present invention to mass produce a promotional or collector's article of inexpensive and easily manufactured materials.

It is a further objective to produce an advertising device which may be shipped in large quantities in a knockdown position and be readily assembled by the users thereof into a highly durable and attractive miniature promotional unit.

It is also an object of the present invention to provide a promotional device which has factory formed sections therein such that the device may be easily assembled without the use of separate fastener elements.

It is a further object to provide a collector's item having factory formed sections therein such that the device will be securely retained in its fully assembled position.

It is a still further object to demonstrate a promotional article which may be fabricated of lightweight materials to reduce shipping and warehousing costs in the distribution of such articles.

Further objects and advantages of the present invention will become apparent as the following description proceeds, and the features of novelty characterizing the invention will be pointed out with particularity in the claims annexed to and forming a part of this specification.

In particular, the invention relates to a miniature bay trailer assembly having the trademarks of a particular beverage manufacturer printed thereon.

In production of the promotional device, a flat sheet of corrugated fiberboard material is die cut into a uniquely engineered design which allows the flat sheet to be readily assembled by the user into a durable and highly attractive display item designed to enhance retail sales of a particular product.

PRIOR ART PATENTS

The most relevant prior art patents presently known to the inventor herein are listed as follows: U.S Pat. Nos. 1,330,654 issued to Pittman on Feb. 10, 1920; 537,735 issued to Trufant on Apr. 16, 1895; 3,261,619 issued to Norgaard on July 19, 1966; 2,581,100 issued to Hennessy on Jan. 1, 1952; 953,593 issued to Brown on Mar. 29, 1910; and 935,865 issued to Seward on Oct. 5, 1909.

With the exception of the Hennessy patent, each of the above references shows a type of foldable display vehicle using wheels as a part of the design. The prior art patents illustrate the relatively complex assembly procedures heretofore required in the art. For example, most prior art teachings require the use of separate fasteners or adhesives to complete the assembly. Such is in direct contrast to the easily assembled structure of the present invention.

The prior art patents further illustrate the relative instability of foldable display articles heretofore used in the art. In contrast, the present invention utilizes uniquely engineered folding pattern and design which results in an end product which, while requiring no separate fasteners, is highly durable in its intended display use. The present design also incorporates aesthetic qualities heretofore unknown in the assemblable display arts.

BRIEF DESCRIPTION OF THE DRAWING FIGURES

DESCRIPTION OF THE PREFERRED EMBODIMENT

Figure 1:
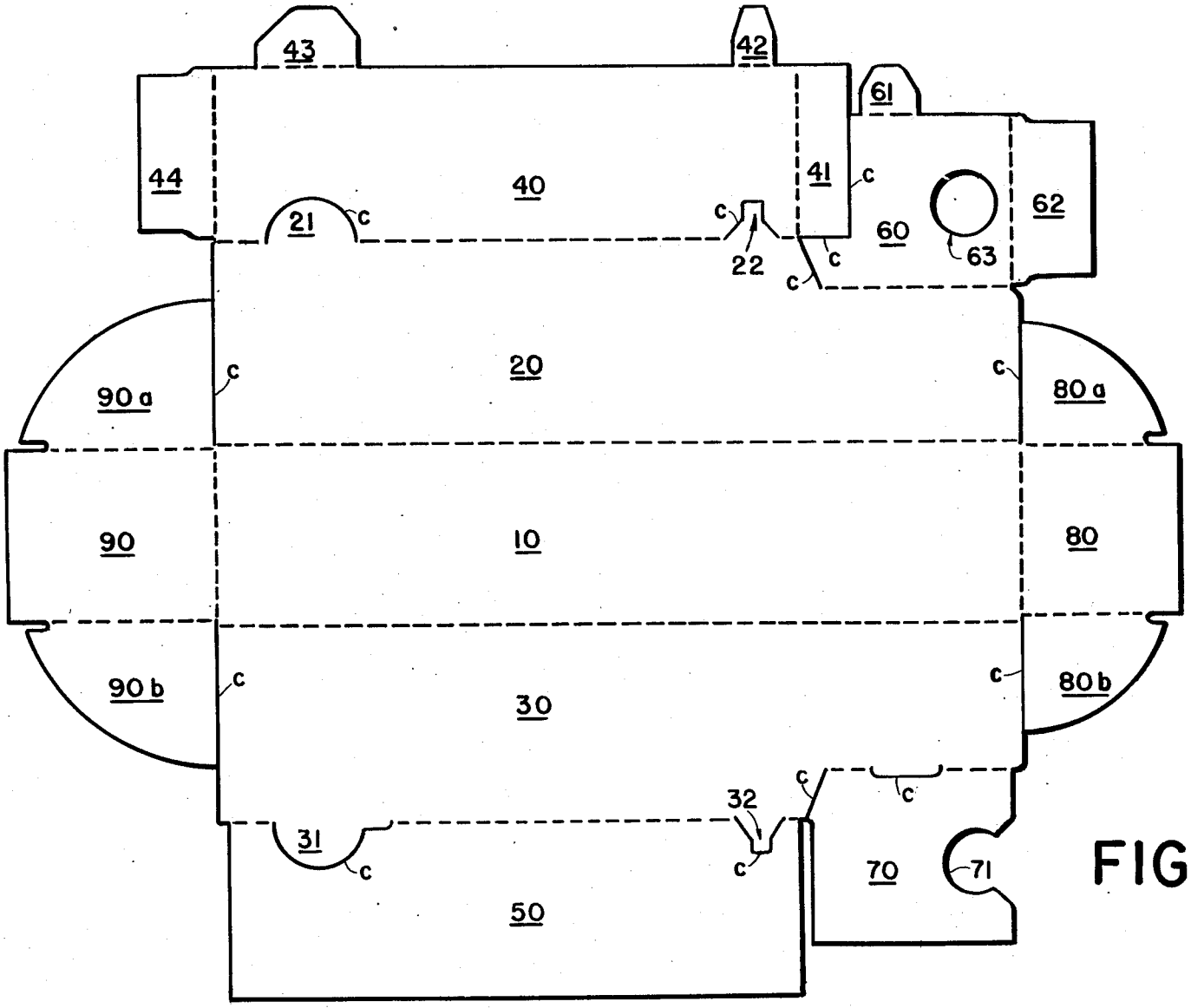
FIG. 1 is a plan view of a flat sheet of corrugated fiberboard having cuts and score lines formed therein in a design which may be folded easily into the shape of a bay trailer assembly.

Referring now to FIG. 1, the bay trailer assembly is shown in its flat or knockdown position for shipping purposes.

As shown in its flat position, the corrugated fiberboard has factory applied fold lines shown as dashed lines and factory applied cut through portions shown a solid lines and normally designated by the letter C.

The main sections 10 through 90 are shown as defined by dashed score lines therebetween. The score lines are factory pre-formed utilizing known steel rule die technology. It should be noted that the solid line sections designated by the letter C represent factory cut through portions to facilitate, for example, the formation of wheel sections 21 and 31 and the elevated trailer attachment means 60 and 70 upon assembly of the device.

As appreciated from the knockdown view of FIG. 1, the one-piece bay trailer comprises a rectangular central section 10 which forms the top of the trailer upon assembly, first and second trailer side wall sections 20 and 30, end panel sections 40 and 50 which overlap to form the bay trailer bottom wall upon assembly, a rear trailer panel 90 attached to the central section 10 and having flaps formed thereon, a front trailer wall 80 having flaps formed thereon, and trailer hitch or coupling panels 60 and 70 which are positioned one on top of the other in assembly of the device of FIG. 1.

The unique design may best be illustrated by describing the method of assembly of the bay trailer of FIG. 1.

End panel sections 40 and 50 are manually grasped and folded over to such position that section 40 overlies section 50. In this position, tabs 42 and 43 are tucked into the apertures formed by the cut lines shown adjacent numerals 32 and 31 respectively. Once the tabs 42 and 43 are tucked in, an elongated rectangular tube is formed with wheel sections 21 and 31 and trailer stand means 22 and 32 depending from said elongated rectangular tube.

Next flap 44 is bent inwardly ninety degrees as are flaps **90*a* and 90*b*. Thus, the rear trailer panel 90 may be folded upwardly such that the flaps 90*a* and 90*b* are internally positioned with respect to trailer side walls 20 and 30**.

To complete the assembly of the front portion of the bay trailer, flap 41 is folded inwardly ninety degrees. Trailer hitch sections 60 and 70 are then folded inwardly ninety degrees such that section 60 overlies section 70 and tab 61 is tucked into the cut portion C of section 70. Hitch section apertures 63 and 71 allow attachment to a display truck as desired.

Flap 62 is then folded inwardly ninety degrees as are the side flaps 80*a* and 80*b*. In this position, the bay trailer front wall 80 may be folded inwardly such that its connected flap means 80*a* and 80*b* lie in a position internal of the trailer side wall means 20 and 30.

Figure 2:
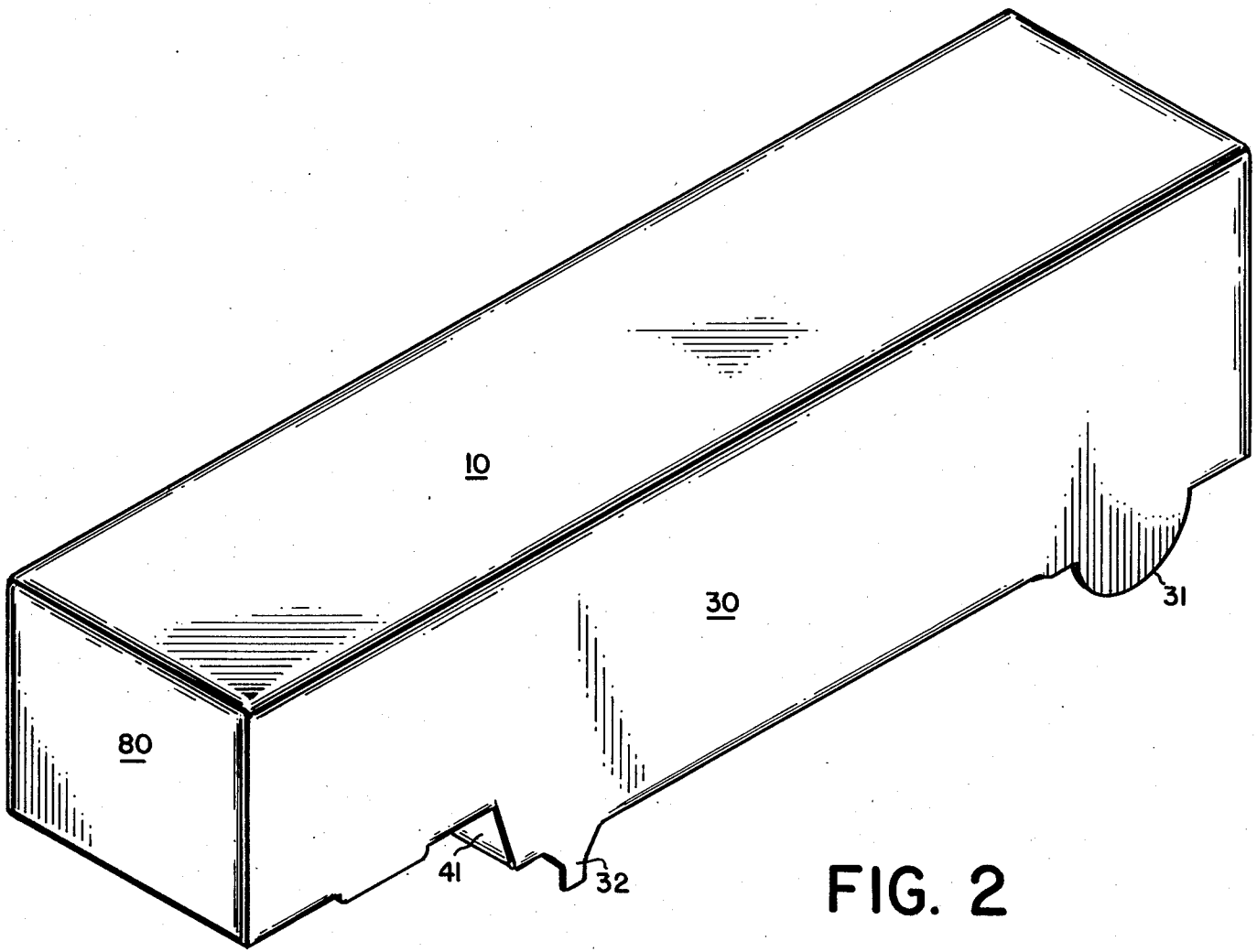
FIG. 2 is a view of the bay trailer in its assembled condition for display use.

Suitable printed promotional material, such as an advertisement for a particular product, may be applied to the corrugated material in its flattened position before shipping, i.e. applied to the portions of the apparatus which are visible upon the assembly of FIG. 2.

It will thus be appreciated by those of skill in the art that an easy to assemble vet durable and attractive miniature bay trailer promotional aid is achieved by means of the factory cut corrugated fiberboard design.

The engineered shapes disclosed are of course critical to both the ease of assembly of the device and the durability and attractiveness of the assembled product.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A bay trailer display assembly means which may be shipped in a flat position and easily assembled by the user thereof comprising:

a single sheet of foldable material having a rectangular central section (10) formed thereon by means of factory applied score lines, a first trailer side wall panel (20) attached to a first side of said central section (10), a second trailer side wall panel (30) attached to a second side of said central section (10), wherein both of said trailer side wall panels (20, 30) have wheel sections (21, 31) and trailer stand means (22, 32) formed therein by means of factory applied cut through portions (C), a first end panel section means (40) attached to said first trailer side wall panel (20), a second end panel section means (50) attached to said second trailer side wall panel (30), means whereby said first end panel section (40) is folded so as to overlie said second end panel section means (50) so as to form the bottom wall of the bay trailer assembly, tab means (42, 43) formed on said first end panel section means (40) for retaining the bay trailer in an assembled position, rear trailer panel means (90) attached to said rectangular central section (10) at a first end thereof, front trailer wall means (80) attached to said rectangular central section (10) at a second end thereof(.), wherein said rear trailer panel means (90) has flap means (90*a*, 90*b*) attached thereto, wherein said front trailer wall means (80) has flap means (90*a*, 90*b*) attached thereto, wherein said first trailer side wall panel (20) has a first hitch section means (60) attached to a forward lateral edge thereof, wherein said first hitch section means (60) has tab element (61) formed thereon, wherein said second trailer side wall panel (30) has a second hitch section means (70) attached to a forward lateral edge thereof via a factory applied score line therebetween, including a cut through portion means (C) formed as a part of said second hitch section (70) for receiver of said tab element (61), formed as a part of said first hitch section (60), wherein said first and second hitch sections (60, 70) have aperture means (63, 71) formed therein and sized so as to be in alignment upon assembly of the apparatus, wherein said first end panel section means (40) has flap means (41, 44) formed at both ends thereof, wherein said first hitch section means (60) has a flap means (62) formed on a forward edge thereof.

* * * * *